US012723830B1

(12) United States Patent
Wilke et al.

(10) Patent No.: US 12,723,830 B1
(45) Date of Patent: Sep. 1, 2026

(54) HARMONICALLY BALANCED FIREARM SUPPRESSOR SYSTEM

(71) Applicants: Benjamin Kurt Wilke, Clive, IA (US); Jim Jeter, Jacksonville, FL (US)

(72) Inventors: Benjamin Kurt Wilke, Clive, IA (US); Jim Jeter, Jacksonville, FL (US)

( * ) Notice: Subject to any disclaimer, the term of this patent is extended or adjusted under 35 U.S.C. 154(b) by 0 days.

(21) Appl. No.: 19/066,587

(22) Filed: Feb. 28, 2025

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/28; F41A 21/325; F41A 21/32
USPC ..... 89/14.3, 14.4; 181/223
See application file for complete search history.

(56) References Cited

U.S. PATENT DOCUMENTS 5,279,200 A 1/1994 Rose
5,794,374 A * 8/1998 Crandall ..... F41C 27/22 42/76.01
9,115,949 B1 * 8/2015 Morrison ..... F41G 11/001
9,285,178 B2 3/2016 Sellars
9,671,188 B2 6/2017 Sellars
11,703,303 B1 * 7/2023 Bray ..... F41A 21/36 124/83
12,072,159 B2 8/2024 Wragg et al.
2024/0240901 A1 * 7/2024 Cortina ..... F41A 21/30

* cited by examiner

*Primary Examiner* — Michael D David
(74) *Attorney, Agent, or Firm* — SALIWANCHIK, LLOYD & EISENSCHENK

(57) ABSTRACT

A suppressor system of a firearm is provided. The suppressor system comprises a plurality of shims; a casing having a proximal end and a distal end; a first endcap coupled to the proximal end of the casing; a removable baffle disposed within the casing; a second endcap coupled to the distal end of the casing; and a plurality of adjustable weights coupled to the second endcap. The adjustable weights and shims of the suppressor system are configurable to modify the vibration harmonic waveforms of a barrel of the firearm once a bullet is fired. As a result, both consistency and accuracy for rifles or pistols to which the suppressor system is attached are improved.

17 Claims, 7 Drawing Sheets

HARMONICALLY BALANCED FIREARM SUPPRESSOR SYSTEM

BACKGROUND OF THE INVENTION

Shooters have long attempted to improve their gun's accuracy by glass bedding the barrels, using thicker (stiffer) barrels, or reloading their own ammunition and adjusting the gunpowder and bullet weight. While these methods may be effective for target rifles or hunting rifles, they are not practical for improving accuracy in most firearms.

In the 1990s, Browning developed the "BOSS" (Ballistic Optimizing Shooting System)—an adjustable muzzle device that could be moved axially along the barrel's end, thereby altering the barrel harmonics by shifting the weight. This device allowed shooters to maximize their rifle's accuracy regardless of the ammunition used (U.S. Pat. No. 5,279,200 A). Other patents have also explored various methods of adjusting barrel harmonics to enhance firearm accuracy, such as U.S. Pat. Nos. 9,671,188 B2 and 9,285,178 B2.

Suppressors, due to their inherent design as weight added to the end of the barrel, naturally function as dampeners to limit barrel vibrations. However, unlike the Browning BOSS system, these suppressors are not typically adjustable and thus cannot be fine-tuned to optimize the firearm's accuracy.

BRIEF SUMMARY OF THE INVENTION

There continues to be a need in the art for improved designs and techniques for harmonically balanced firearm suppressor systems.

In an embodiment, a firearm suppressor/tuner kit is provided that comprises a casing having a proximal end and a distal end; a first endcap attachable to the proximal end of the casing; a second endcap attachable to the distal end of the casing; a removable baffle configured to be disposed within the casing; a plurality of shims, optionally of a variety of different thicknesses; and a plurality of weights couplable to the second endcap and optionally of a variety of different masses. The kit can optionally also comprise one or more specialized tools that are configured to remove the adjustable weights from the second endcap and/or remove the suppressor from a firearm barrel. According to another embodiment of the subject invention, a suppressor system of a firearm comprises a plurality of shims; a casing having a proximal end and a distal end; a first endcap coupled to the proximal end of the casing; a removable baffle disposed within the casing; a second endcap coupled to the distal ends of the casing; and a plurality of adjustable weights coupled to the second endcap. The plurality of shims can be of a variety of different thicknesses, and the plurality of shims are configured to be disposed between an end of the first barrel and the suppressor to provide fine-tune adjustment to vibration harmonic waveforms of the first barrel after the firearm fires a shot. Moreover, the casing is a single piece and has a length between 4 inches and 8 inches. The casing may have a diameter of about 1.5 inches. The first endcap can be securely fixed to a firearm barrel. For example, the first endcap can be securely fixed to the firearm barrel with threads. In operation, the first endcap is formed with cutouts, allowing a user to remove the suppressor from the firearm barrel. The casing has an internal ledge that provides a hard stop for the removable baffle, inhibiting the baffle from moving inside the casing. In a preferred embodiment, proximal to this ledge the casing has a tapered wall "blast chamber" followed by porting to allow airflow through a venturi effect, cooling the suppressor. The casing has a distal end formed with threads to receive the second endcap. The removable baffle is preferably a single piece, formed by 3D printing, allowing gas to be diverted and impeded as it flows through the baffle and slows through the process. The baffle is configured to reduce back-pressure that can damage the firearm and cause toxic fumes to flow back to the face of a user. The baffle is removable for cleaning or exchange. The second endcap is formed with threads to be secured onto the distal end of the casing, facilitating locking the baffle into position within the casing. The second endcap has one central hole with a larger diameter for a bullet to pass through, and a plurality of holes with smaller diameters around its periphery to allow excess gas to escape. The adjustable weights are preferably configured to be threaded into the second end cap. Furthermore, the adjustable weights each have one central hole with a larger diameter for a bullet to pass through and a plurality of peripheral holes with smaller diameters to allow gas to escape and preferably to render each weight to be removable via a specialized tool.

In another embodiment, a method of using a firearm suppressor that comprises a removable baffle, removable weights and removable shims, is provided. The method comprises grossly adjusting the firearm suppressor; and fine-tuning the firearm suppressor. The grossly adjusting the firearm suppressor comprises firing a series of shots and subsequently adjusting weights of various masses at an end of the firearm suppressor to determine a combination of weight that provides the most accurate bullet groupings. Moreover, the fine-tuning the firearm suppressor comprises adjusting shims, optionally of a variety of thicknesses for optimizing a vibration harmonic waveform of the barrel of the firearm to maximize accuracy of shooting by the firearm, the shims being disposed between the barrel and the suppressor.

BRIEF DESCRIPTION OF THE DRA WINGS

DETAILED DISCLOSURE OF THE INVENTION

Figure 1:
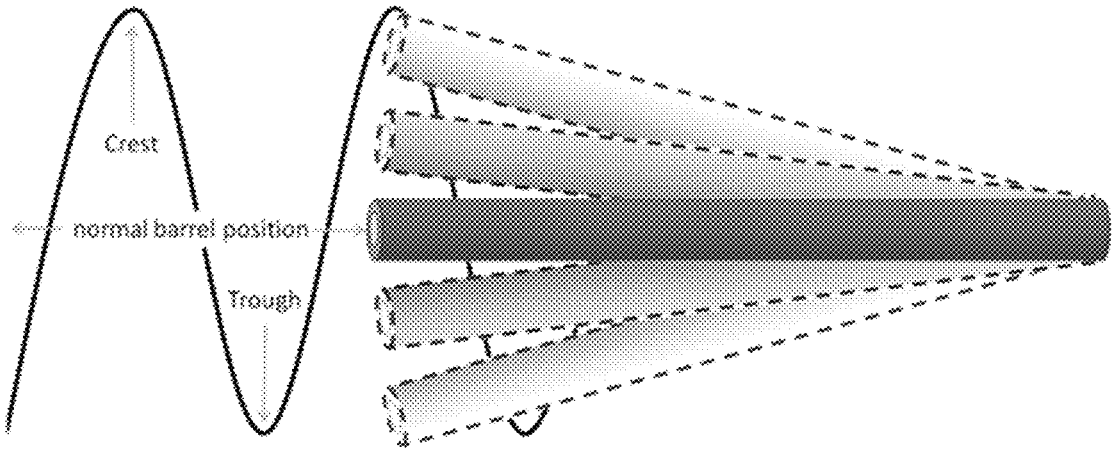
FIG. 1 depicts a representation of a gun barrel harmonic waveform after the gun is fired.

The embodiments of subject invention pertain to a suppressor system of a firearm. The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising,"

when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention pertains. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

When the term "about" is used herein, in conjunction with a numerical value, it is understood that the value can be in a range of 90% of the value to 110% of the value, i.e. the value can be +/−10% of the stated value. For example, "about 1 kg" means from 0.90 kg to 1.1 kg.

In describing the invention, it will be understood that a number of techniques and steps are disclosed. Each of these has individual benefits and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Barrel tuners are weighted instruments that are normally placed at the end of the barrel. Often used by competition shooters, these devices assist with improvements in accuracy. By using small adjustments in the weight along the length of the barrel, a shooter can fine-tune the firearm accuracy with a given ammunition, matching the harmonic waveform of the barrel to the bullet. Previously, use of these tuners would prohibit the shooter from attaching a suppressor to the end of the firearm.

According to the embodiments of the subject invention, a suppressor system is provided, capable of adding or removing weights to tune the accuracy of any firearm using any caliber of ammunition.

The suppressor system differs from existing tuner devices in its approach to adjusting weight—by adding or removing weights, rather than shifting the weights axially along the barrel. Further, by adding or removing shims, both weight and axial positioning of the suppressor can be finely and delicately adjusted to optimize accuracy. In contrast, no existing suppressor allows a user to shift the device axially in such manner for the purposes of improving accuracy. Additionally, the suppressor system of the subject invention is detachable and can be fitted to any firearm. Further, in preferred embodiments the suppressor has novel baffle configurations.

In particular, the suppressor device of the subject invention can be configured to modify the barrel harmonics and improve accuracy by removable weights. For all guns, the barrel will vibrate once the gun is fired. For greatest accuracy the bullet should exit the end of the barrel when the barrel is closest to the normal position as shown in FIG. 1, rather than at the crest or trough. When the bullet exits the barrel depends on several variables, such as barrel length, barrel stiffness, bullet speed, and amount of gunpowder.

Figure 2:
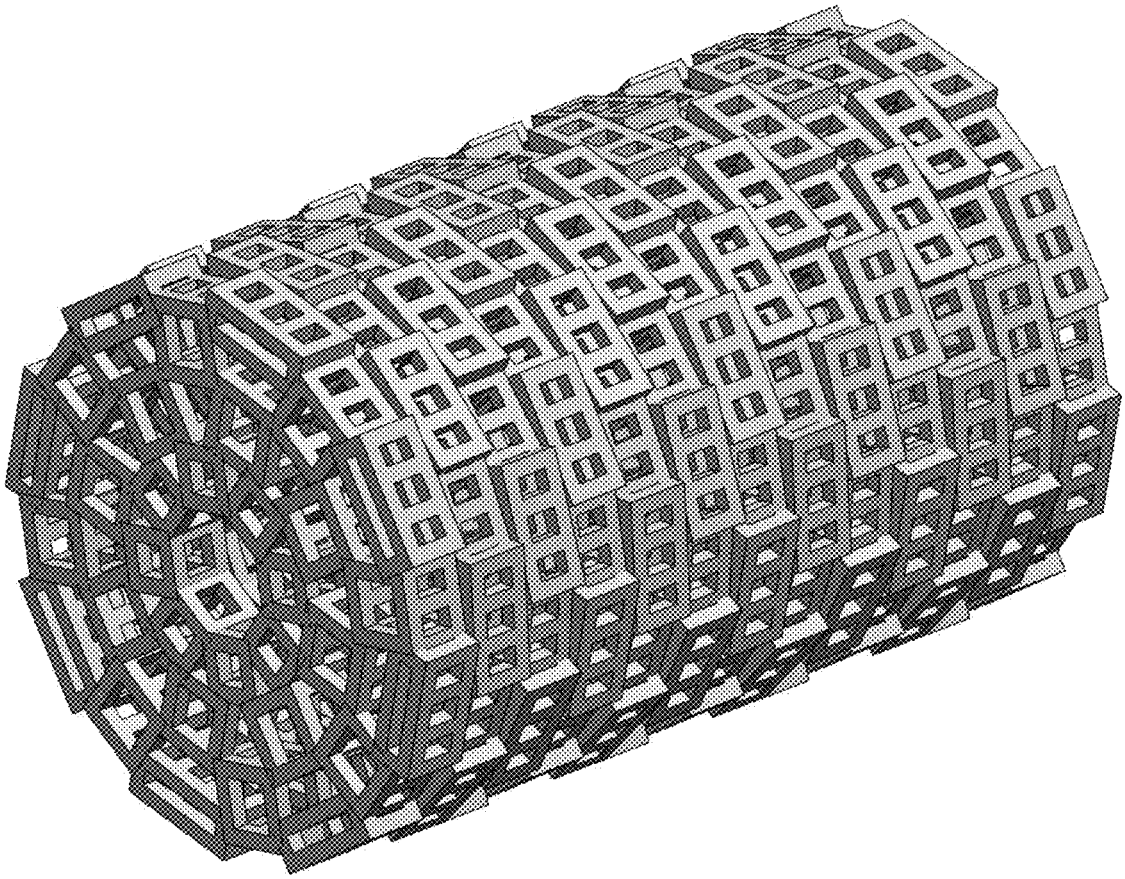
FIG. 2 is a perspective view of a suppressor baffle embodiment having a cubed lattice structure.
Figure 3:
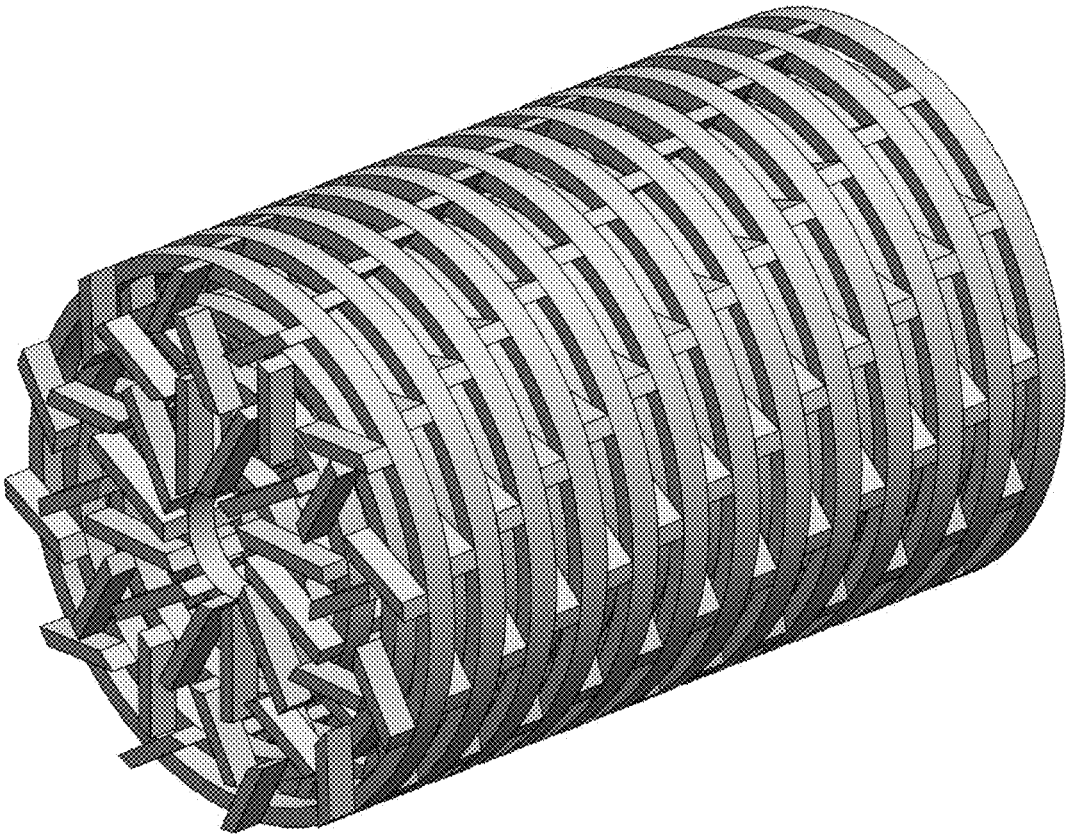
FIG. 3 is a perspective view of a suppressor baffle embodiment having a structure shaped like a turbine fan.
Figure 6:
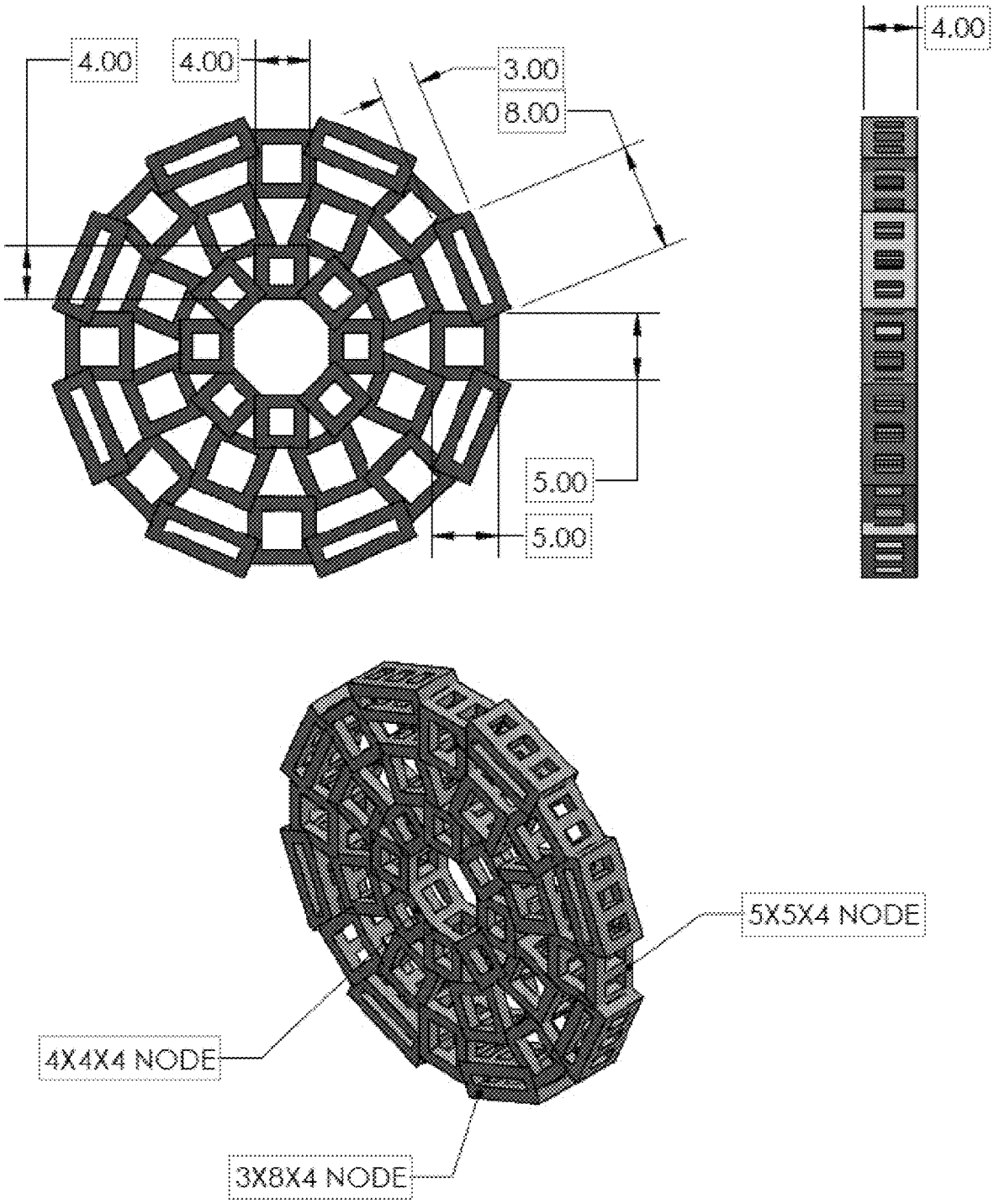
FIG. 6 shows the structure of the first embodiment of the baffle, according to the subject invention.
Figure 7:
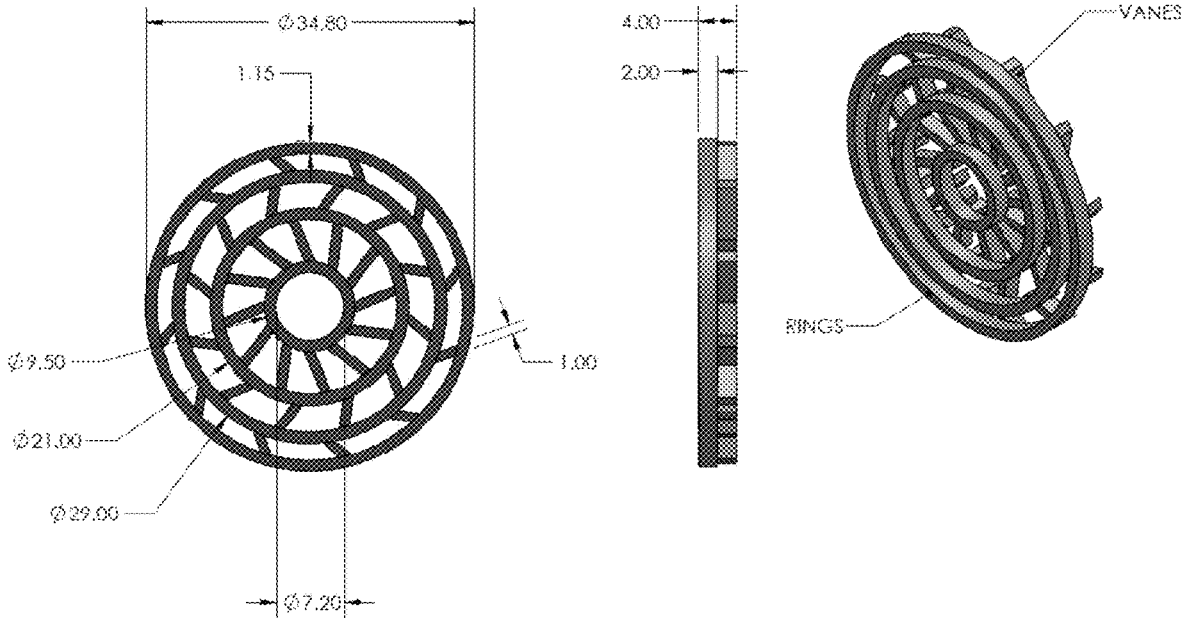
FIG. 7 shows the structure of the second embodiment of the baffle, according to the subject invention.

There are two preferred embodiments for the baffle that act to deflect gases while limiting weight and back pressure. The first embodiment is a cubed lattice structure as shown in FIG. 2 and FIG. 6. The second embodiment is a structure shaped like a turbine fan with concentric rings connected by respective pluralities of vanes, as shown in FIG. 3 and FIG. 7.

In one embodiment, a suppressor system is provided, allowing a user to fine tune accuracy of the firearm similar to a barrel tuner. Unlike the existing barrel tuners, the suppressor system of the subject invention affects the waveform by using adjustable weights and shims. The suppressor system is more readily able to be switched between firearms and has the benefit of providing enhanced noise suppression.

The suppressor system is designed based on a combination of removable weights and shims that allow for precise adjusting of the weight at the end of the barrel, which in turn affects the harmonic waveform once a bullet is fired. To use the device, a user would simply begin by attaching the suppressor to their firearm and firing a series of shots. After this initial group of shots, the user would then begin adjusting the weights at the end of the suppressor to find the weight that provides the most accurate bullet groupings. This stage represents gross adjustment-a preliminary phase aimed at roughly determining the best weight setup.

After completing the gross adjustment with the removable weights, the user can further refine the accuracy through a fine adjustment process. This involves using shims, preferably of varying thicknesses, which are placed between the barrel and the suppressor. Taken together, between the gross and fine adjustments, the user has many options to most closely match their barrel's harmonic waveform with any type of ammunition fired. The fine adjustment allows for much more subtle tuning, enabling the user to make incremental changes that maximize accuracy. By experimenting with different shim configurations, the shooter can fine-tune the interaction between the barrel and suppressor, optimizing the rifle's performance with greater precision.

These comprehensive adjustment processes ensure that the firearm is optimized for accuracy, regardless of the type of ammunition used, offering a highly customizable shooting experience.

Besides the removable weights and shims, the suppressor system of the subject invention allows for a completely removable baffle system for cleaning or exchange. The baffles are single core designs rather than stacked sets as found in existing suppressors. The baffles are designed to allow gas to "flow-through" in order to limit blowback to the shooter. The suppressor casing and endcap have cutouts to allow the user to remove each with a specialized tool. Similarly, the removable weights have holes to allow excess gas escape and to accept a specialized tool for removal.

Figure 4:
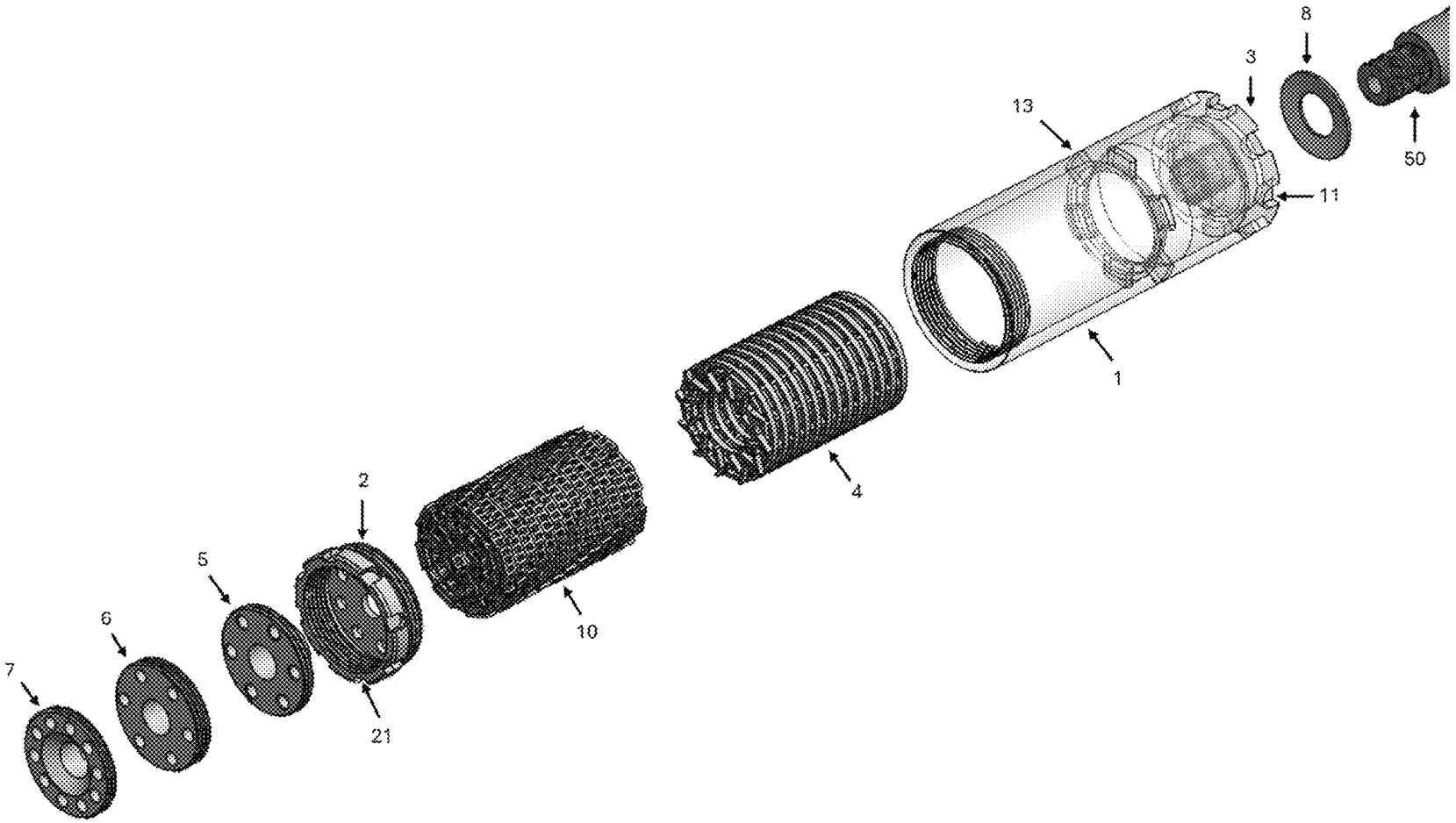
FIG. 4 is an exploded view of an embodiment of a suppressor according to the subject invention.

Referring to FIG. 4, the suppressor system includes a casing 1, a second endcap 2, a first endcap 3, a first baffle 4, a plurality of adjustable weights 5-7, a plurality of shims 8, and a second baffle 10.

Figure 5:
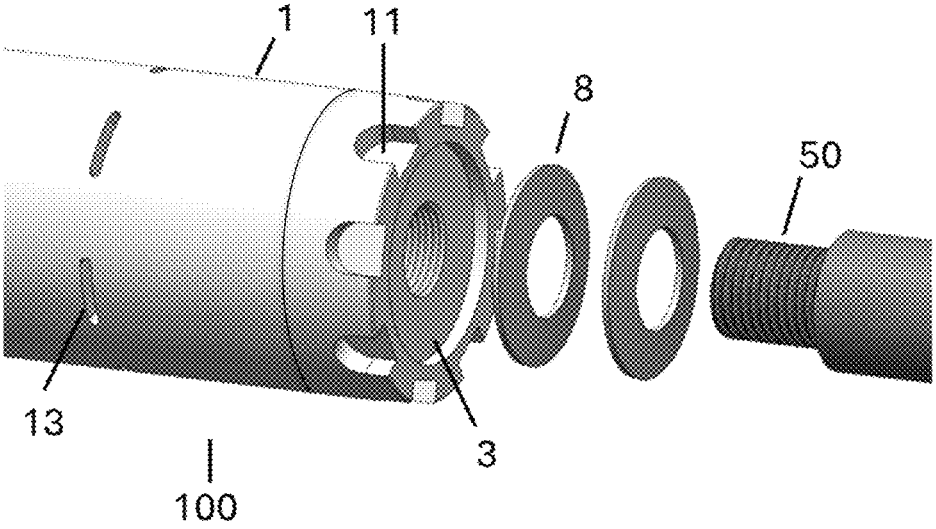
FIG. 5 is an exploded view demonstrating how the barrel, adjustable shims and suppressor connect, according to the subject invention.

In one embodiment, the plurality of shims 8 may have various thicknesses that are placed between the end of the firearm barrel and the suppressor in order to provide fine-tune adjustment to the barrel harmonic waveform, after gross adjustment is complete. FIG. 5 shows how the barrel 50, adjustable shims 8 and suppressor 100 connect together.

Figure 8:
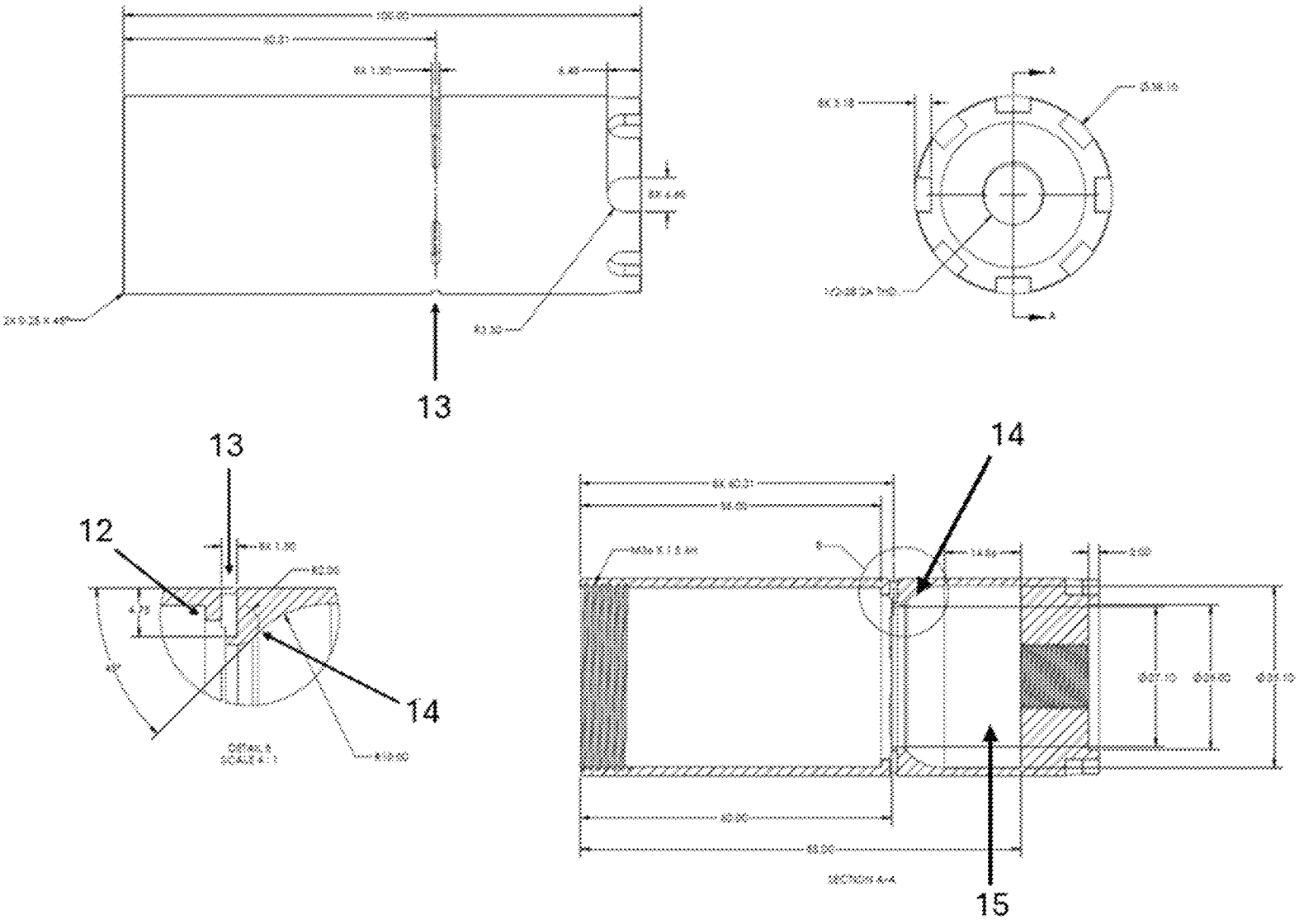
FIG. 8 is a drawing of a preferred embodiment of the casing, demonstrating the internal structure.

The casing 1 is a single piece that may be of varying length, preferably between 4 inches and 8 inches and has a diameter of, for example, about 1.5 inches. The casing 1 has an endcap 3 that is secured (for example, by threads) onto the firearm barrel 50 and has cutouts 11 that allow a user to use a complementarily configured specialized tool to remove the suppressor from the barrel. The casing 1 has an internal ledge 12 that provides a hard stop for a removable baffle, inhibiting the baffle from moving inside the casing. A preferred embodiment of the casing is shown in FIG. 8, which depicts that in addition to the ledge 12 to hold the baffle, the casing has a tapered wall 14 at the distal aspect of the blast chamber designed to speed up airflow in front of the ports 13, a plurality of which are disposed around the casing, circumferentially penetrating the casing and allowing airflow into the suppressor through a venturi effect, cooling the suppressor. The casing 1 is threaded on its distal end to receive the endcap 2.

The baffle 4 or 10 is a single piece that may be 3D printed, allowing gas to flow through and become trapped and be slowed through the process. Preferred embodiments of the baffle are shown in FIGS. 2 and 6 (first embodiment) and FIGS. 3 and 7 (second embodiment), respectively. The baffle is designed to reduce back-pressure, which can damage a firearm and cause toxic fumes to flow back to the user's face. The baffle systems can be of various designs (i.e., varying lengths, weights, and densities of structure) as will be apparent to those skilled in the art to favor weight or gas/noise reduction. They are removable for easy cleaning or exchange.

The endcap 2 is preferably threaded onto the end of the casing and helps lock the baffle in position. The endcap 2 has cutouts 21 around the periphery to enable removal of the endcap with a complementarily configured specialized tool. The endcap has one large diameter hole centrally for the bullet, and a plurality of smaller holes in the periphery of the endcap to allow excess gas to escape.

The adjustable weights 5-7 are designed to thread into the endcap. These similarly have one large central hole for the bullet and a plurality of smaller peripheral holes to allow increased gas escape and for ease of removal with a complementarily configured specialized tool.

The suppressor system of the subject invention offers several advantages, including a one-piece, flow-through baffle that is preferably 3D printed and removable for easy cleaning, as shown in FIGS. 6 and 7.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application and the scope of the appended claims. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

REFERENCES

1. U.S. Pat. No. 9,671,188B2
2. U.S. Pat. No. 9,285,178B2
3. U.S. Pat. No. 12,072,159B2

We claim:

1. A suppressor system of a firearm, comprising: a casing having a proximal end and a distal end; a first endcap coupled to the proximal end of the casing; a removable single piece baffle formed by 3D printing and disposed within the casing, the baffle allowing gas to flow through and become trapped and the gas flow to be slowed through the process; a second endcap coupled to the distal end of the casing; and a plurality of adjustable weights coupled to the second endcap; wherein the plurality of adjustable weights are adjustable at a distal end of the suppressor system to determine a weight that provides most accurate bullet groupings.

2. The suppressor system of claim 1, further comprising a shim, wherein the shim and/or a thickness of the shim is adjustable to optimize a vibration harmonic waveform of a barrel of the firearm to maximize accuracy of shooting by the firearm.

3. The suppressor system of claim 1, further comprising a plurality of shims, the shims having a variety of thicknesses, wherein the plurality of shims and/or the thicknesses of the plurality of shims are adjustable to optimize a vibration harmonic waveform of a barrel of the firearm to maximize accuracy of shooting by the firearm.

4. The suppressor system of claim 1, wherein the casing is a single piece.

5. The suppressor system of claim 1, wherein the casing has a length between 4 inches and 8 inches and a diameter of about 1.5 inches.

6. The suppressor system of claim 1, wherein the casing comprises a plurality of ports.

7. The suppressor system of claim 6, wherein the casing comprises an internal tapered wall proximal to the ports.

8. The suppressor system of claim 1, wherein the first endcap is formed with a plurality of circumferentially spaced cutouts around its outer edge.

9. The suppressor system of claim 1, wherein the casing has an internal ledge that provides a hard stop for the removable baffle.

10. The suppressor system of claim 1, wherein the casing has a distal end formed with threads to receive the second endcap.

11. The suppressor system of claim 1, wherein the baffle is configured as a cubed lattice structure.

12. The suppressor system of claim 1, wherein the baffle comprises a plurality of concentric rings connected by respective pluralities of vanes.

13. The suppressor system of claim 1, wherein the second endcap is formed with threads to be secured onto an end of the casing, facilitating locking the baffle within the casing.

14. The suppressor system of claim 1, wherein the second endcap is formed with a plurality of circumferentially spaced cutouts around its outer edge.

15. The suppressor system of claim 1, wherein the second endcap comprises one central hole with a larger diameter for a bullet to pass through, and a plurality of holes, each having a smaller diameter than the central hole, in its periphery.

16. The suppressor system of claim 1, wherein the adjustable weights are configured to be threaded into the second end cap.

17. The suppressor system of claim 1, wherein each of the adjustable weights has one central hole with a larger diameter for a bullet to pass through, and a plurality of peripheral holes having smaller diameters than the central hole.

* * * * *